US005642616A

United States Patent [19]

Park

[11] Patent Number: 5,642,616

[45] Date of Patent: Jul. 1, 1997

[54] FLUID PRESSURE CONTROL SYSTEM FOR HYDRAULIC EXCAVATORS

[75] Inventor: Hee Woo Park, Seoul, Rep. of Korea

[73] Assignee: Daewoo Heavy Industries Ltd., Incheon, Rep. of Korea

[21] Appl. No.: 524,314

[22] Filed: Sep. 6, 1995

[30] Foreign Application Priority Data

Sep. 6, 1994 [KR] Rep. of Korea ..... 94-22344

[51] Int. Cl.[6] ..... F16D 31/02

[52] U.S. Cl. ..... 60/426; 60/452

[58] Field of Search ..... 60/422, 426, 427, 60/452

[56] References Cited

U.S. PATENT DOCUMENTS 4,938,023 7/1990 Yoshino ..... 60/427

5,209,063 5/1993 Shirai et al. ..... 60/422

5,347,811 9/1994 Hasegawa et al. ..... 60/426

5,460,000 10/1995 Kropp ..... 60/422

*Primary Examiner*—Hoang Nguyen

*Attorney, Agent, or Firm*—Lowe, Price, LeBlanc & Becker

[57] ABSTRACT

A fluid pressure control system for hydraulic excavators includes a load sensing valve in communication with first and second pressure compensator valves via a load sensing line and responsive to a load sensing pressure developed in the load sensing line for regulating the discharge volume of a working fluid and a swing torque regulator lying midway of the load sensing line between the load sensing valve and the first pressure compensator valve to selectively allow and inhibit a fluid communication between the first pressure compensator valve and the load sensing valve depending on the pressure of a pilot fluid.

7 Claims, 5 Drawing Sheets

FLUID PRESSURE CONTROL SYSTEM FOR HYDRAULIC EXCAVATORS

FIELD OF THE INVENTION

The present invention pertains to a fluid pressure control system for use in industrial vehicles and, more specifically, to a fluid pressure control system capable of effectively controlling the combined or independent actuation of a hydraulic boom cylinder and a hydraulic swing motor with which excavators or mobile diggers are equipped to carry out a wide variety of works.

DESCRIPTION OF THE PRIOR ART

As is known to those skilled in the art, conventional excavators include a moving undercarriage, an upper swing frame mounted pivotally on the undercarriage for horizontal turning movement thereabout, a boom held in front of the upper swing frame for vertical angular movement within a limited extent and a bucket pivotally carried on the distal end of the boom by way of an interconnecting arm. The upper swing frame may be caused to swing by a hydraulic swing motor and the boom may be subjected to pivotal movement on a vertical plane in response to the extension or retraction of a hydraulic boom cylinder. The pivotal movement of the bucket is effectuated in a similar way by its own hydraulic cylinder. Actuation of the swing motor, the boom cylinder and the bucket cylinder can be properly controlled through the use of a fluid pressure control system to thereby enable the excavators to carry out digging, excavating, earth-moving and other like tasks assigned thereto.

The fluid pressure control system employed in the prior art excavators, however, has proven to pose at least two-fold drawbacks as further explained below. First of all, the fluid pressure in the swing motor is highly likely to soar in the event that the upper swing frame of heavyweight nature is caused to turn with a strong torque against the inertia thereof. This will adversely affect the precise control of the swing motor speed as a matter of course. Secondly, in case where the boom cylinder is actuated in synchronism with the swing motor, the fluid pressure in the swing motor tends to become unduly greater than the fluid pressure developed in the boom cylinder, with the result that the upper swing frame will turn at a far faster speed than the boom is lifted up.

For avoidance of the above noted drawbacks, U.S. Pat. No. 4,938,023 to Yoshino on Jul. 3, 1990 discloses a fluid pressure control system comprising a first selector valve for controlling the action of a first actuator, a second selector valve for controlling the action of a second actuator, a first flow control valve for controlling flow of a fluid to be supplied to the first actuator, and a second flow control valve for controlling flow of a fluid to be supplied to the second actuator. A pressure reducing valve is provided for reducing the pressure of the fluid supplied to the second actuator. The pressure on the outlet side of the pressure reducing valve is controlled by a proportional pressure relief valve which is controlled by an external pilot pressure.

The fluid pressure control system taught in the '023 patent may offer significant advantages over the prior art system in that the turning speed of the upper swing frame can be controlled to match the ascending speed of the boom. Nevertheless, it is evident that certain shortcomings remain unsolved in accordance with the '023 patent. One disadvantage is that pressure loss may often occur at a swing motor side relief valve and a boom cylinder side pressure compensator valve due to the pressure surge in the swing motor during the process of starting-up movement of the upper swing frame. As a result, the fluid pressure control system becomes unable to perform its task in an efficient manner and at a reduced energy consumption rate. Another disadvantage is the requirement of using additional valves to match the upper swing frame turning speed with the boom ascending speed, which in turn makes the fluid pressure control system hard-to-fabricate and costly.

SUMMARY OF THE INVENTION

It is an object of the invention to provide a fluid pressure control system for hydraulic excavators that can eliminate the deficiencies inherent in the prior art devices and further that can substantially avoid or minimize pressure loss in a fluid pressure circuitry to thereby reduce energy consumption, while assuring a precise control of the swing motor speed in an exact proportion to the pivot angle of a joy stick or operating knob.

Another object of the invention is to provide a fluid pressure control system for hydraulic excavators which makes it possible to retain an optimum speed balance between a swing motor and a boom cylinder in case of the combined actuation of both.

With these objects in view, the present invention resides in the provision of a fluid pressure control system for hydraulic excavators having an upper swing frame and a boom, which comprises: a fluid reservoir; a variable displacement pump in communication with the reservoir for discharging a variable volume of pressurized working fluid; a hydraulic swing motor rotatably driven by virture of the working fluid to cause rotation of the upper swing frame; a first flow control valve operable to control flow of the working fluid with respect to the swing motor; a joy stick adapted for pivotal movement to change the position of the first flow control valve with the use of a pilot fluid; a first pressure compensator valve positioned downstream of the first flow control valve to compensate the fluid pressure acting on the swing motor; a hydraulic cylinder adapted for extension and retraction by virtue of the working fluid to cause elevational movement of the boom; a second flow control valve operable to control flow of the working fluid with respect to the hydraulic cylinder; a second pressure compensator valve located downstream of the second flow control valve to compensate the fluid pressure acting on the hydraulic cylinder; a load sensing valve in communication with the first and second pressure compensator valves via a load sensing line and responsive to a load sensing pressure developed in the load sensing line for regulating the discharge volume of the working fluid; and a swing torque regulator lying midway of the load sensing line between the load sensing valve and the first pressure compensator valve to selectively allow and inhibit a fluid communication between the first pressure compensator valve and the load sensing valve depending on the pressure of the pilot fluid.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
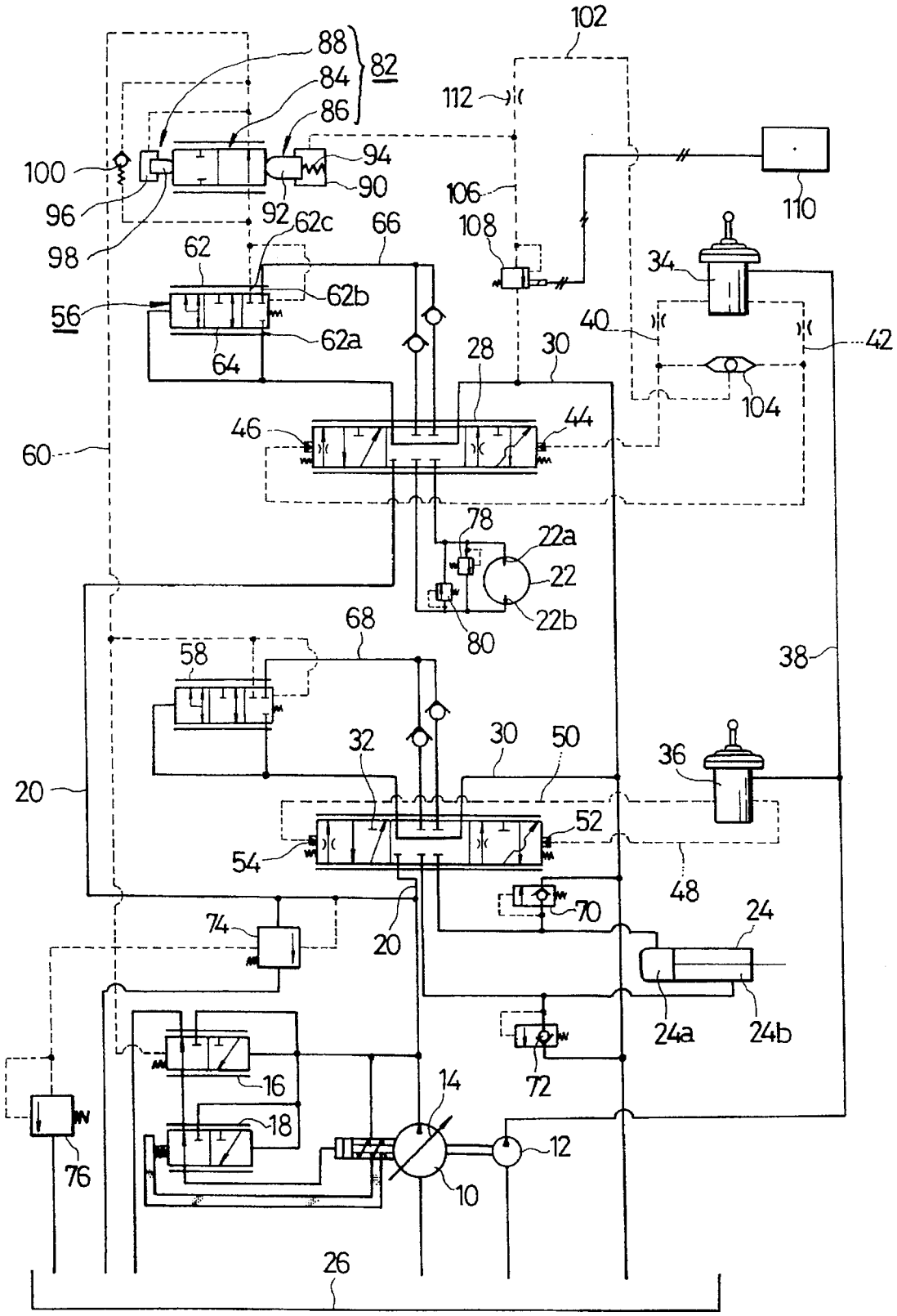
FIG. 1 is a hydraulic circuit diagram showing the fluid pressure control system in accordance with the invention.

Referring now to FIG. 1, the hydraulic control system embodying the present invention comprises a variable displacement pump 10 for the production of high pressure working fluid and an auxiliary pump 12 creating low pressure pilot fluid, both of which are driven by a prime mover not shown in the drawings for simplicity. The variable displacement pump 10 is typically provided with a swash plate 14 that serves to alter the discharge volume of the working fluid depending on the inclination angle thereof. The inclination angle of the swash plate 14 is controlled by means of a load sensing valve 16 and a horsepower control valve 18. It should be understood that the discharge volume of the working fluid fluctuates in proportion to the swash plate inclination angle, namely, the greater the inclination angle grows, the more working fluid the viable displacement pump discharges.

The working fluid produced by the pump 10 is delivered to a hydraulically operated swing motor 22 and a hydraulic boom cylinder 24 by way of a main supply line 20. The swing motor 22 is used to turn a upper swing frame (not shown) of the excavator in a forward or reverse direction and has first and second fluid communication holes 22*a*, 22*b* through which the working fluid flows into or out of the swing motor 22. Meanwhile, the boom cylinder 24 is adapted to raise or lower a boom (not shown) of the excavator and has first and second pressure chambers 24*a*, 24*b* which are fed with the working fluid to cause extension and retraction of the boom cylinder 24.

A first flow control valve 28 is utilized either to cause the working fluid to be admitted into the swing motor 22 or permit the working fluid to be drained to a fluid reservoir 26 from the swing motor 22. Specifically, the first flow control valve 28 is position-controlled by virtue of a pilot unit set forth later such that the working fluid can be either admitted into or prohibited from entering the swing motor 22 via one of the fluid communication holes 22*a*, 22*b*. The working fluid exhausted from the swing motor 22 goes to the fluid reservoir 26 by way of a main drain line 30.

A second flow control valve 32 is used to control delivery of the working fluid either between the pump 10 and the boom cylinder 24 or between the boom cylinder 24 and the fluid reservoir 26. As with the first flow control valve 28 set out above, the second valve 32 is position-controlled by virtue of the pilot unit to effectuate extension and retraction of the boom cylinder 24. The working fluid exhausted from the boom cylinder 24 goes to the fluid reservoir 26 via the main drain line 30.

The pilot unit for position-controlling the first and second flow control valves 28, 32 includes, inter alia, a first joy stick 34 and a second joy stick 36, both of which can be subjected to manual pivotal movement by the driver. The first joy stick 34 is connected to the auxiliary pump 12 via a pilot fluid supply line 38 and serves depending on its pivot angle, to cause the pilot fluid to be delivered to either of first and second pilot pressure chambers 44, 46 through first and second control lines 40, 42. It can be noted that the pilot chambers 44, 46 are provided at opposite ends of the first flow control valve 28. In the event that the pilot fluid should be fed to the first pilot chamber 44, the first flow control valve 28 will move to the left. To the contrary, introduction of the pilot fluid into the second pilot chamber 46 will cause the first flow control valve 28 to move rightwise.

The second joy stick 36 is also connected to the auxiliary pump 12 via the pilot fluid supply line 38 and serves, depending on its pivot angle, to cause the pilot fluid to be fed to either of third and fourth pilot pressure chambers 52, 54 through third and fourth control lines 48, 50. It can be seen that the third and fourth pilot chambers 52, 54 are arranged at opposite ends of the second flow control valve 32. Supplying the pilot fluid to the third pilot chamber 52 will result in a leftward movement of the second flow control valve 32, whereas admission of the pilot fluid into the fourth pilot chamber 54 will lead to a rightward displacement of the second flow control valve 32.

A first pressure compensator valve 56 lies downstream of the first flow control valve 28 for fluid communication therewith, with a second pressure compensator valve 58 placed downstream of the second flow control valve 32 in a similar way. The first pressure compensator valve 56 is in fluid communication with the second pressure compensator valve 58 via a load sensing line 60 which in turn leads to the load sensing valve 16. At the time when the load pressure developed in the swing motor 22 is less than the load pressure induced at the boom cylinder 24, the first pressure compensator valve 56 will be shifted to throttle a first connection line 66 that interconnects the first flow control valve 28 and the swing motor 22, thereby reducing the quantity of the working fluid to be fed to the swing motor 22. In case of the load pressure in the swing motor 22 being greater than that of the boom cylinder 24, the first pressure compensator valve 56 will leave the first connection line 66 unthrottled, thus allowing a large quantity of the working fluid to enter the swing motor 22. In this case, the load sensing line 60 comes into fluid communication with the first connection line 66 to receive the load pressure from the swing motor 22.

Likewise, as long as the load pressure acting on the boom cylinder 24 remains less than the load pressure of the swing motor 22, the second pressure compensator valve 58 will continue to throttle a second connection line 68 that interconnects the second flow control valve 32 and the boom cylinder 24, thereby reducing the quantity of the working fluid to be supplied to the boom cylinder 24. Conversely, should the load pressure acting on the boom cylinder 24 grows larger than the load pressure of the swing motor 22, the second pressure compensator valve 58 will no longer throttle the second connection line 68, which would enable a great quantity of the working fluid to be delivered to the boom cylinder 24. At that time, the load sensing line 60 is brought into fluid communication with the second connection line 68 to receive the load pressure of the boom cylinder 24.

For the very reason stated above, the load sensing pressure in the load sensing line 60 is equated with the load pressure acting on the swing motor 22 or the load pressure associated with the boom cylinder 24, whichever is greater than the other. The load sensing valve 16 set forth earlier is adapted to be position-controlled by the magnitude of pressure differential between the load sensing pressure in the load sensing line 60 and the fluid pressure at the exit of the variable displacement pump 10, so that the fluid discharge volume can be properly regulated in response to the load pressure exerting on the swing motor 22 or the boom cylinder 24.

It can be seen in FIG. 1 that the first pressure compensator valve 56 is provided with a valve body 62 and a valve spool 64 slidably fitted into the valve body 62. The valve body 62 has an inlet port 62*a* leading to the variable displacement pump 12 by way of the first flow control valve 28, a first outlet port 62*b* connected to the swing motor 22 via the first flow control valve 28 and a second outlet port 62*c* selectively coupled to the load sensing line 60. And, the valve spool 64 of the first pressure compensator valve 56 is adapted to assume one of first, second and third positions depending on the pressure differential between the pump pressure acting on one end of the valve spool 64 and the load sensing pressure exerting against the other end thereof.

At the time when the valve spool 64 is in the first position, namely, the leftmost position, as shown is FIG. 1, the inlet port 62*a* of the valve body 62 will be disconnected from the first and second outlet ports 62*b*, 62*c*, so that no fluid communication may occur between the pump 10, the swing motor 22 and the load sensing line 60. With the valve spool 64 placed in the second, middle position, the inlet port 62*a* of the valve body 62 comes into connection with the first outlet port 62*b* alone, thus allowing the working fluid to enter the swing motor 22. Simultaneous connection of the inlet port 62*a* with the first and second outlet ports 62*b*, 62*c* will take place in case where the valve spool 64 is moved to the third, rightmost position.

One of the important features of the invention is that a swing torque regulator 82 is positioned across the load sensing line 60 in the vicinity of the second outlet port 62*c* of the first pressure compensator valve 56. The swing torque regulator 82 serves to either allow or inhibit fluid communication beween the first pressure compensator vlave 56 and the load sensing valve 16 depending on the magnitude of the pilot pressure delivered from the joy stick 34.

To perform the function noted above, the swing torque regulator 82 is of the construction including a spool 84 shiftable between a first position in which the first pressure compensator valve 56 is allowed to communicate with the load sensing valve 16 via the load sensing line 60 and a second position in which the first pressure compensator valve 56 is disconnected from the load sensing valve 16, a first spool actuator 86 for applying the pilot pressure to one end of the spool 84 to urge the latter into the first position as illustrated in FIG. 1 and a second spool actuator 88 for exerting the load sensing pressure to the other end of the spool 84 to bias the latter into the second position.

The first spool actuator 88 includes a pilot chamber 90, a pilot piston 92 extendably fitted into the pilot chamber 90 and having a relatively great diameter, i.e., pressure receiving area, and a compression spring 94 normally biasing the pilot piston 92 against the spool 84. On the other hand, the second spool actuator 88 is provided with a load sensing chamber 96 remaining in communication with the load sensing line 60 and a load sensing piston 98 extendably inserted through the load sensing chamber 96 with its tip contacting the spool 84. The diameter of the load sensing piston 98 is smaller than that of the pilot piston 92 of the first spool actuator 88 such that the pressure receiving areas of both pistons 88, 98 should become different from each other. Attached to the load sensing line 60 in parallel with the swing torque regulator 82 is a check valve 100 which functions to permit delivery of the load sensing pressure from the load sensing line 60 tward the first pressure compensator valve 56, particularly when the spool 84 of the swing torque regulator 82 is in the second, right-handed position. This will enable the position of the first pressure compensator valve 56 to be governed by the load pressure of the hydraulic boom cylinder 24.

The pilot chamber 90 of the first spool actuator 86 is coupled to the first and second control lines 40, 42 by way of a pilot pressure line 102 and a shuttle valve 104, whereby the pilot fluid whose pressure varies with the angle of the joy stick 34 can be admitted into the pilot chamber 90. The pilot pressure line 102 has a juncture from which a pilot drain line 106 is branched off to connect the pilot pressure line 102 with the main drain line 30. Somewhere along the pilot drain line 106, an electronic proportional control relief valve 108 is located that serves to changeably set a pilot relief pressure above which the pilot fluid in the pilot pressure line 102 begins to be drained off into the fluid reservoir 26. The electronic relief valve 108 is able to change the pilot relief pressure in an exact correspondence to the electric current supplied thereto from an electronic controller 110. It is preferred, and even necessary, to provide an orifice 112 on the pilot pressure line 102 between the electronic relief valve 108 and the shuttle valve 104. The orifice plays a key role in prohibiting an abrupt drop of the pilot pressure in the first and second control lines 40, 42, which would otherwise result in an erroneous position control of the first flow control valve 28.

Figure 2:
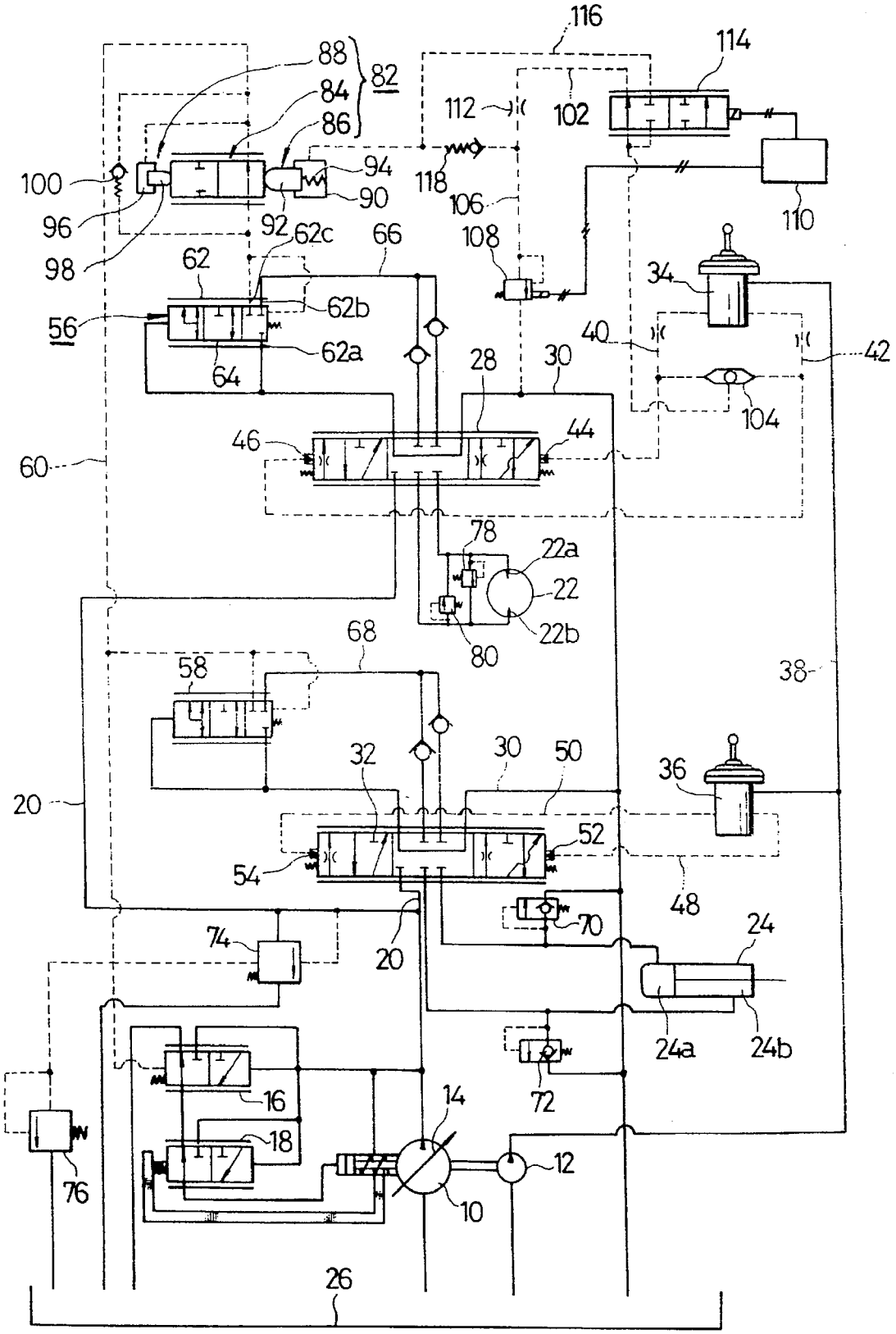
FIG. 2 shows a modification of the fluid pressure control system illustrated in FIG. 1.

Turning to FIG. 2, there is shown a modification of the fluid pressure control system in accordance with the invention. The modified fluid pressure control system further includes a switching valve 114 whose position is controlled by means of the electronic controller 110. Stated more specifically, the switching valve 114 can be shifted between a first position, as shown in FIG. 2, in which the pilot fluid is permitted to be supplied to the first spool actuator 86 by way of the inlet port of the electronic relief valve 108 and a second position in which the pilot fluid is directly fed to the first spool actuator 86 via a bypass line 116. It should be noted that a check valve 118 is provided on the pilot pressure line 102 to inhibit a backflow of the pilot fluid toward the electronic relief valve 108 when the switching valve 114 is in the second position. Remainder of the components in the modified fluid pressure control system does not differ from those illustrated in FIG. 1 and, therefore, needs no repetitive explanation.

Operation or behavior of the fluid pressure control system will be described in the following. If the joy stick 34 is operated to displace the first flow control valve 28, the working fluid filled in the main supply line 20 will be fed to the first pressure compensator valve 56 via the first flow control valve 28 whereby the spool 64 is caused to move from the illustrated, leftmost position to the middle position, thus allowing the working fluid to enter the swing motor 22 via the first interconnection line 66.

As the pressure of the working fluid becomes much greater due to the load pressure in the swing motor 22, the spool 64 of the first pressure compensator valve 56 is progressively shifted toward the rightmost position to thereby effectuate fluid communication between the first outlet port 62*b* and the second outlet port 62*c* of the valve body 62, assuring a transfer of the load pressure in the swing motor 22 to the load sensing line 60 via the swing torque regulator 82. The load sensing pressure developed in the load sensing line 60 in this way is introduced into the load sensing chamber 96 of the second spool actuator 88 to have the load sensing piston 98 moved rightwardly, which results in the load pressure of the swing motor 22 being no longer delivered to the load sensing line 60. This leads to a reduction of the load sensing pressure and hence a decrease of the fluid discharge volume in the variable displacement pump 10.

Meanwhile, if the pilot fluid is introduced into the pilot chamber 90 of the first spool actuator 86 via the pilot pressure line 102 in response to the operation of the joy stick 34, the pilot piston 92 will be extended to bias the spool 84 leftwardly to thereby permit communication between the second outlet port 62*c* of the valve body 62 and the load sensing line 60. This enables the load pressure in the swing motor 22 to be transmitted to the load sensing line 60, which increases the load sensing pressure acting on the load sensing valve 16 to make the variable displacement pump 10 produce a greater mount of the working fluid. Such increase in the fluid discharge volume will cause the load pressure in the swing motor 22 to increase accordingly, thereby applying a greater torque to the swing motor 22.

The load sensing pressure LS, the magnitude of which is controlled by virtue of the swing torque regulator, can be expressed by the equation:

$$LS = \frac{Al}{As} \cdot Pi + k \cdot \frac{\delta}{As}$$

wherein "As" denotes the pressure receiving area of the load sensing piston 98, "Al" the pressure receiving area of the pilot piston 92, "Pi" the pilot pressure acting on the pilot piston 92 of the first spool actuator 86, "κ" the constant of κ" the compression spring 94 and "δ" the displacement of the spring 94.

Figure 3:
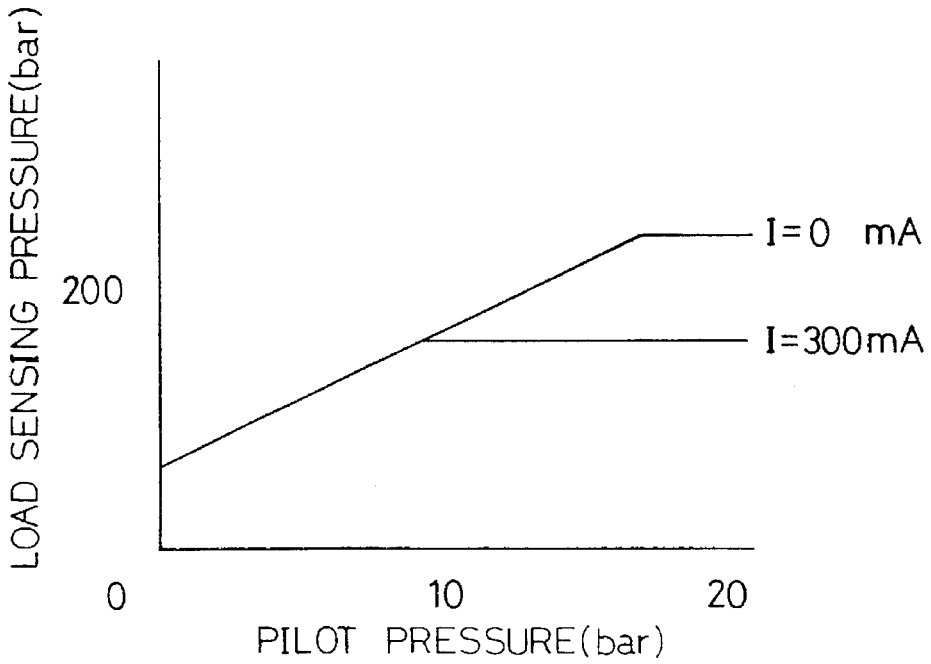
FIG. 3 graphically represents the correlation of the pilot pressure supplied to a swing torque regulator and the load sensing pressure developed in a load sensing line.
Figure 4:
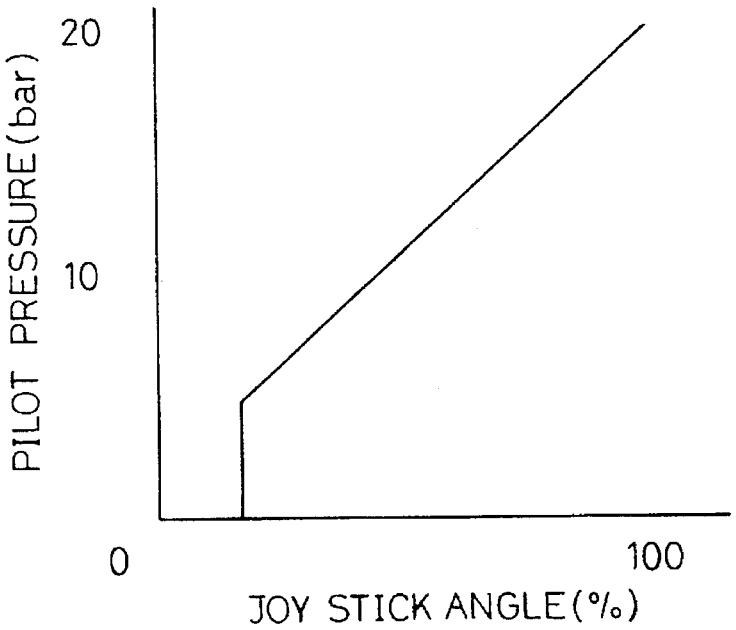
FIG. 4 depicts the variation of the pilot pressure in a pilot pressure line against the operating angle of a joy stick.

As is apparent from the equation, the load sensing pressure LS varies with and depends on the pilot pressure Pi, the correlation of which is illustrated in FIG. 3. When the joy stick 34 is operated by the driver, the pilot fluid will be admitted into the pilot chamber 90 of the first spool actuator 86 via the shuttle valve 104 and the pilot pressure line 102, at which time the pilot pressure increases in proportion to the angle of the joy stick 34, as can be confirmed in FIG. 4. Accordingly, the desired pilot pressure, load sensing pressure and swing load pressure, i.e., swing torque, can be attained simply by changing the operating angle of the joy stick 34.

Figure 5:
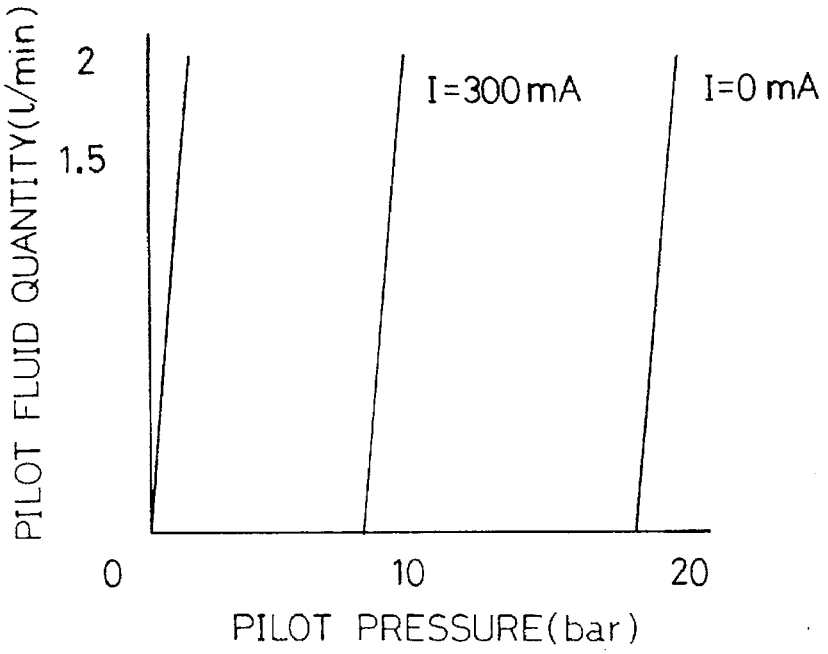
FIG. 5 is a graphical representation showing the pressure and quantity of the pilot pressure against the electric current fed to an electronic proportional control relief valve.

The electronic relief valve 108 serves to drain the pilot fluid into the fluid reservoir 26 in case where the pilot pressure in the pilot pressure line 102 exceeds the pilot relief pressure preselected thereby. The pilot relief pressure can be changed by way of increasing or decreasing the electric current fed to the electronic relief valve 108, since the pilot relief pressure varies in a reverse proportion to the intensity of the electric current, as shown in FIG. 5. The upper limit of the pilot pressure and hence the load sensing pressure is determined by the pilot relief pressure. Specifically, in case of the electric current being 0 mA, the pilot fluid is drained at the pressure of 20 bar through the electronic relief valve 108, which allows the load sensing pressure to reach as high a valve as 280 bar. If the electric current is increased up to, e.g., 300 mA, the pilot fluid begins to drain at 10 bar to thereby delimit the load sensing pressure to below 160 bar. Moreover, pressure loss in the swing motor relief valves 78, 80 can be avoided even if the joy stick 34 is operated to its maximum angle, provided that the relief pressure of the swing motor relief valves 78, 80 is set to such a value greater than the maximum load sensing pressure at the current level of 0 mA.

Figure 6:
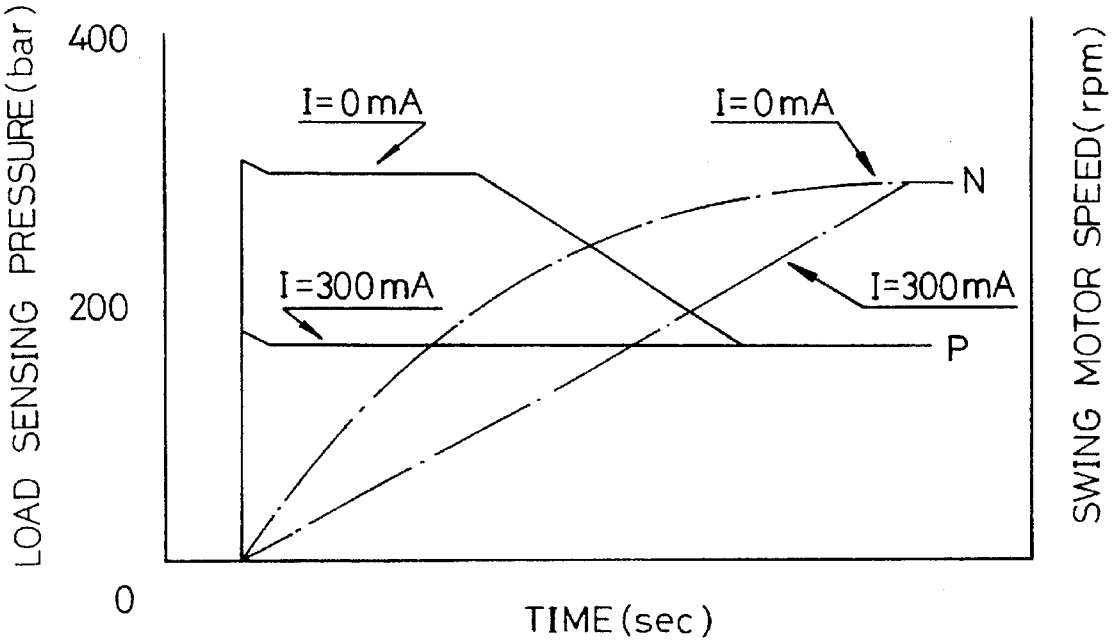
FIG. 6 is a view illustrating the change of the load sensing pressure and the swing speed over time with respect to the electric current applied to the electronic relief valve.
Figure 7:
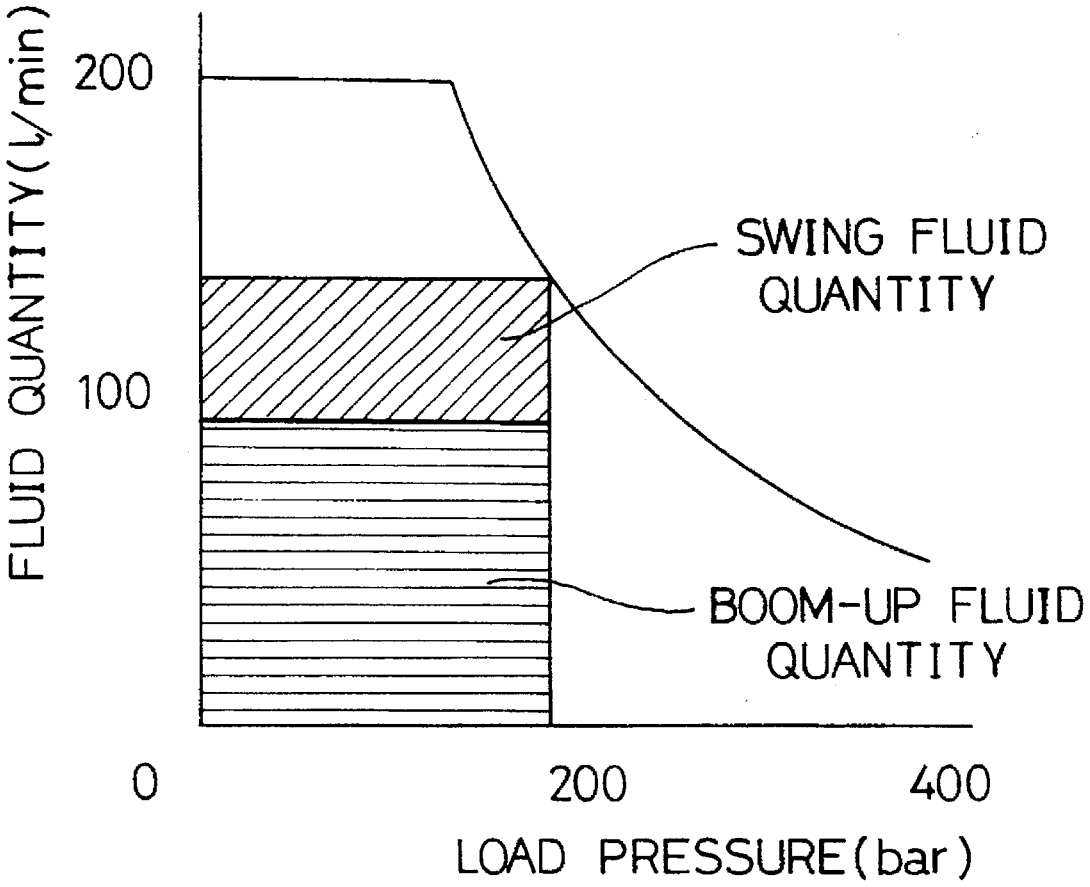
FIG. 7 shows the correlation between the working fluid quantity and load pressures in the swing motor and the boom cylinder.

During the combined actuation of the swing motor 22 and the boom cylinder 24, if the electric current fed to the electronic relief valve 108 is set to 0 mA, the swing load pressure will be increased up to 280 bar, for instance, to make greater the swing torque and the speed of the swing motor as illustrated in FIG. 6. In contrast, the maximum swing load pressure will be confined to 160 bar with a decrease in the speed of the swing motor 22, when the electric current remains as high as 300 mA. Such a speed-down of the swing motor 22 leads to a speed-up of the boom cylinder 24, thus substantially equating the speeds of both with each other, as can be seen in FIG. 7, which helps retain the optimum balance of the boom-up speed and the swing speed of the upper swing frame. Furthermore, it becomes possible to avoid any pressure loss which may take place in the second pressure compensator valve 58 when the swing load pressure is exceedingly high.

In the event that the swing motor 22 alone is to be actuated with the boom cylinder 24 remaining still, the switching valve 114 should be shifted leftwardly in FIG. 2 so that the pilot fluid can be directly introduced into the pilot chamber 90 of the first spool actuator 86 with no chance of drainage in the electronic relief valve 108. As a result, the swing load pressure can reach the relief pressure set by the relief valves 78, 80 to maximize the speed of the swing motor and the upper swing frame.

While the invention has been described with reference to a preferred embodiment, it should be apparent to those skilled in the art that many changes and modifications may be made without departing from the spirit and scope of the invention as defined in the claims.

What is claimed is:

1. A fluid pressure control system for hydraulic excavators having an upper swing frame and a boom, which comprises: a fluid reservoir; a variable displacement pump in communication with the reservoir for discharging a variable volume of pressurized working fluid;

a hydraulic swing motor rotatably driven by virtue of the working fluid to cause rotation of the upper swing frame;

a first flow control valve operable to control flow of the working fluid with respect to the swing motor;

a joy stick adapted for pivotal movement to change the position of the first flow control valve with the use of a pilot fluid;

a first pressure compensator valve positioned downstream of the first flow control valve to compensate the fluid pressure acting on the swing motor;

a hydraulic cylinder adapted for extension and retraction by virtue of the working fluid to cause elevational movement of the boom;

a second flow control valve operable to control flow of the working fluid with respect to the hydraulic cylinder;

a second pressure compensator valve located downstream of the second flow control valve to compensate the fluid pressure acting on the hydraulic cylinder;

a load sensing valve in communication with the first and second pressure compensator valves via a load sensing line and responsive to a load sensing pressure developed in the load sensing line for regulating the discharge volume of the working fluid; and a wing torque regulator lying midway of the load sensing line between the load sensing valve and the first pressure compensator valve to selectively allow and inhibit a fluid communication between the first pressure compensator valve and the load sensing valve depending on the pressure of the pilot fluid, wherein the swing torque regulator comprises a spool shiftable between a first position in which the first pressure compensator valve is allowed to communicate with the load sensing valve and a second position in which the first pressure compensator valve is disconnected from the load sensing valve, a first spool actuator for applying the pilot pressure to one end of the spool to urge the spool into the first position and a second spool actuator for applying the load sensing pressure to the other end of the spool to bias the spool into the second position.

2. The fluid pressure control system for hydraulic excavators as recited in claim 1, further comprising a check valve attached to the load sensing line in parallel with the swing torque regulator for, when the spool of the swing torque regulator is in the second position, permitting the load sensing pressure to be transmitted from the load sensing line to the first pressure compensator valve.

3. The fluid pressure control system for hydraulic excavators as recited in claim 2, wherein the joy stick is connected to the first flow control valve via first and and second control lines to enable the pilot fluid to be fed to the opposite ends of the first flow control valve and wherein the first spool actuator is in fluid communication with the first and second control lines via a pilot pressure line and a shuttle valve.

4. The fluid pressure control system for hydraulic excavators as recited in claim 3, Wherein the pilot pressure line is coupled to the reservoir through a pilot drain line branched off from the pilot pressure line, and further comprising an electronic proportional control relief valve attached to the pilot drain line for changeably setting a pilot relief pressure above which the pilot fluid begins to be drained from the pilot pressure line.

5. The fluid pressure control system for hydraulic excavators as recited in claim 4, wherein the pilot pressure line is provided with an orifice located between the electronic relief valve and the shuttle valve for, when the electronic relief valve is open, prohibiting an abrupt drop of the fluid pressure in the first and second control lines.

6. The fluid pressure control system for hydraulic excavators as recited in claim 4, further comprising a switching valve shiftable between a first position in which the pilot fluid is permitted to be supplied to the first spool actuator by way of an inlet port of the electronic relief valve and a second position in which the pilot fluid is directly fed to the first spool actuator via a bypass line.

7. The fluid pressure control system for hydraulic excavators as recited in claim 6, further comprising a check valve positioned on the pilot pressure line for, when the switching valve is in the second position, inhibiting a backflow of the pilot pressure toward the electronic relief valve.

* * * * *